United States Patent [19]

Wirtgen

[11] Patent Number: 4,614,379

[45] Date of Patent: Sep. 30, 1986

[54] APPARATUS FOR ROUGHENING ROAD SURFACES

[76] Inventor: Reinhard Wirtgen, Hohner Strasse 2, 5461 Windhagen, Fed. Rep. of Germany

[21] Appl. No.: 528,039

[22] Filed: Aug. 31, 1983

[30] Foreign Application Priority Data

Sep. 4, 1982 [DE] Fed. Rep. of Germany ..... 3232985
Dec. 13, 1982 [DE] Fed. Rep. of Germany ..... 3246118

[51] Int. Cl.[4] ..... E21C 35/18

[52] U.S. Cl. ..... 299/39; 37/142 A; 299/86; 299/91

[58] Field of Search ..... 299/39, 86, 89, 91, 299/92, 93; 404/124; 37/142 A

[56] References Cited

U.S. PATENT DOCUMENTS

| | | | |
|---|---|---|---|
| 972,969 | 10/1910 | Wittich | 299/86 |
| 976,703 | 11/1910 | Seberg | 299/89 |
| 1,550,669 | 8/1925 | Bowman | 299/86 |
| 3,072,391 | 1/1963 | McDarrah | 299/86 |
| 3,101,934 | 8/1963 | Poundstone | 299/93 |
| 3,945,681 | 3/1976 | White | 299/86 |
| 4,068,897 | 1/1978 | Amoroso | 299/91 |
| 4,302,053 | 11/1981 | Roepke et al. | 299/86 |
| 4,325,580 | 4/1982 | Swisher, Jr. et al. | 299/39 |

FOREIGN PATENT DOCUMENTS

| | | | |
|---|---|---|---|
| 2136147 | 2/1973 | Fed. Rep. of Germany | 299/39 |
| 837507 | 2/1939 | France | 299/39 |
| 1030110 | 5/1966 | United Kingdom . | |
| 2037223 | 7/1980 | United Kingdom | 299/39 |
| 608923 | 5/1978 | U.S.S.R. | 299/86 |

*Primary Examiner*—James A. Leppink
*Assistant Examiner*—Hoang C. Dang
*Attorney, Agent, or Firm*—John S. Roberts, Jr.

[57] ABSTRACT

The invention relates to an apparatus for roughening road surfaces, which consists of a roller which is mounted on a chassis so as to be vertically adjustable, is disposed transversely to the direction of travel, is driven by a motor and is equipped with milling cutters, wherein the milling cutters are fastened resiliently on the roller.

4 Claims, 6 Drawing Figures

APPARATUS FOR ROUGHENING ROAD SURFACES

Highways and motorways, which usually are either made of concrete or have a bituminous surface layer, are subject to continuous wear because of the traffic running on them.

Parts of the surface layer which are much travelled over are worn away, so that ruts are formed, while in addition the entire surface layer loses the necessary roughness and non-skid property which are required for the adhesion of the vehicle tyres running over it.

While the ruts formed can be removed only by milling the entire road surface, the required roughness and non-skid property of the surface can be restored by roughening the surface at certain intervals of time.

For this purpose it is proposed in British Patent Specification No. 1,030,110, dating from the year 1966, to cut grooves of constant depth in the top surface layer in order to obtain a non-skid surface for motorways, airfields and the like.

Nevertheless, a process of this kind requires an extremely complicated machine which works with great accuracy and in which, for example, diamond grinding wheels rotating at high speed are passed over the road surface in order to cut such grooves in the surface. The costs of producing a road surface roughened in this manner are therefore extremely high.

It is also known, for example from U.S. Pat. No. 3,072,391, to treat road surfaces with a roller carrying, distributed over its periphery, beater arms which are pivoted at one end and which because of the centrifugal force resulting from the high speed of rotation of the roller are directed radially outwards and apply a hammer action to the road surface, thus shattering and removing the surface to a certain depth.

A machine of this kind is subject to considerable wear, which also results in very high operating costs.

Another disadvantage of the two processes discussed above is the fact that an expensive special machine has to be used.

For the removal of the previously mentioned ruts and similar damage use is also made of road milling machines, with which a determined amount of the road surface can be removed over a large area without difficulty. These road milling machines are provided with a roller, which is mounted on a chassis so as to be vertically adjustable, is disposed transversely to the direction of travel, is driven by a motor and is equipped with milling cutters.

The milling roller, which has a diameter of the order of 40 cm to about 1.20 meters, rotates relatively slowly in comparison with the previously described roughening machines. The speed of rotation is for example in the range from 50 to 200 revolutions per minute, preferably 100 or 140 revolutions per minute.

With a machine of this kind it is practically impossible to effect a roughening of the road surface, because the entire construction is arranged to enable the milling roller to be guided rigidly at a uniform height over the road surface, so that the latter is removed at a constant height.

Taking starting point a known milling machine of this kind, the problem underlying the present invention is that of providing an apparatus for roughening road surfaces which enables the surface of a road to be given, at a certain intervals of time, a new roughness and non-skid property for the tyres of vehicles running over it.

According to the invention this problem is solved with an apparatus for roughening road surfaces which consists of a roller which is mounted on a chassis so as to be vertically adjustable, is disposed transversely to the direction of travel, is driven by a motor and is equipped with milling cutters, which apparatus is characterised in that the milling cutters are fastened resiliently on the roller.

With these resiliently suspended milling cutters the effect is achieved that when the milling roller—which, as already stated above, has a diameter of about 40 to 120 cm, preferably one meter—rotates at the usual speed for the milling of road surfaces, the milling cutters are guided over the road surface with only a clearly determined contact pressure and, in accordance with this contact pressure, simply roughen the surface but do not in any way completely remove the surface to a clearly determined depth.

With this apparatus according to the invention it is thus possible, without difficulty, to roughen the road surfaces and improve their non-skid property for vehicle tyres.

At the same time the apparatus corresponds to a large extend to the road milling machine which is customarily used for the complete removal of road surface layers, and such a machine can be used for the purpose according to the invention merely by a simple conversion. This conversion consists in screwing on, in place of the milling cutters rigidly screwed on the outer periphery of the milling roller, other milling cutters of resilient construction, while the same fastening devices can expediently be used.

The present invention thus very substantially widens the range of application of the road milling machines at present in use, and in a simple manner, and without any substantial additional expense for apparatus, a solution is provided for the problem underlying the invention, namely the restoration in the most economical manner possible of the necessary surface nature of road surfaces.

In an advantageous embodiment of the apparatus according to the invention, the milling cutters are fastened on the roller by means of leaf springs. The leaf springs are expediently screwed to the roller at one end, for which purpose, for example, it is possible to use the same screws and the same threaded apertures provided in the roller as are also used for fastening the rigid milling cutter holders. The leaf springs then extend tangentially to the circumference of the roller, namely towards the rear in relation to the direction of rotation of the roller, while at their other end a milling cutter is fastened to each of them.

On the one hand through the length of the leaf spring and the strength of the leaf spring, that is to say the width and thickness of the leaf spring, the force of the spring can be varied as desired to suit individual requirements.

On the other hand, the leaf spring can also be suitably shaped so as to be prestressed in a determined manner, so that in this way any required spring force for pressing the milling cutter against the road surface can be achieved.

Since the leaf springs are expediently of uniform construction, the force pressing the milling cutters against the road surface can moreover be further varied and adapted to individual requirements by adjusting the height of the milling roller.

It has furthermore proved very expedient for the milling cutter to be fastened on the leaf spring at an angle to the longitudinal axis of the leaf spring of less than 90°, preferably at an angle of 45°.

In this way optimum results in respect of the roughness obtained are achieved, while in addition the wear on the milling cutters is very slight.

In another advantageous embodiment of the present invention the milling cutters are disposed in a holder provided on the roller, with the interposition of a compression spring.

A form of construction of this kind utilises the usual known pot-shaped milling cutter holders, in which, however, the milling cutters are disposed with clearance and with the interposition of a compression spring. The mounting of the milling cutters in these pot-shaped holders, with the aid of pins, spring rings and the like, provides the necessary clearance to enable the milling cutters to move in these holders in accordance with the deflection of the compression springs used.

Depending on the compression spring used, the force pressing the milling cutters against the road surface can thus be varied and adapted to individual requirements.

It has been found particularly advantageous for the milling cutters to be in the form of round-stem cutters and to be held, with the interposition of a compression spring, by means of a spring ring in the bore of a holder fastened on the roller.

In a construction of this kind a relatively wide groove, whose width corresponds to the deflection of the spring, is provided in the holder to receive the spring ring, so that during operation the round-stem cutter can move in the radial direction, against the force of the spring, in the holder to the extent of the width of this groove.

In this embodiment it has been found particularly advantageous for the holder for the milling cutter to be so constructed that the axis of the milling cutter is inclined out of the radial direction by up to 50° C. in the direction of rotation.

With this arrangement the milling cutter meets the road surface in the optimum position, which has advantageous effects both in respect of the result achieved and in respect of the resistance to wear of the milling cutter.

It has in addition been found very expedient for the milling cutters to be disposed in a helical line on the periphery of the roller. In this way better planar roughening is achieved, in contrast to the groove-like roughening which tends to be obtained with a non-helical arrangement.

The milling cutters used in the apparatus according to the invention are expediently provided with reinforcing sintered carbide or hard metal whereby their life is substantially improved.

According to another embodiment of the present invention the milling cutters can be fastened on the milling roller in a less expensive and simpler manner by fastening them on the roller by means of resilient holders. These resilient holders, which can, for example, consist of hard rubber plates, because of their elastic properties do not transmit, or transmit only to a slight extent, the vibrations and oscillations of the machine to the milling cutters, so that no uncontrolled vibrations of the milling cutters occur. On the other hand, however, they enable the milling cutters to be pressed resiliently against the road surface, so that with an arrangement of this kind the roughening of the road surface can be effected in an ideal manner.

The resilient holders can, for example, be punched out of used motor vehicle tyres in an extremely inexpensive and simple manner, plates of the dimensions 15×15 cm or 20×20 cm having proved particularly expedient. By means of the punching process it is also possible at the same time to form the holes for fastening to the roller and for fastening the milling cutters in these rubber plates.

With the aid of large-headed screws or by the use of suitable washers these rubber-elastic holders can then be screwed directly on the roller, while use can be made of the same internally threaded holes as are normally used for fastening the milling cutters for the milling of road surfaces.

On the opposite edge of the resilient plate the holders for the milling cutters are likewise screwed into the holes punched out for this purpose, and the actual milling cutters, expediently round-stem cutters tipped with sintered carbide or hard metal, are then inserted into the holders. The holders fastened in this manner, together with the milling cutters fastened on them, then project tangentially from the milling roller and during operation are pressed onto the road surface against the elasticity of the holders.

A likewise very suitable raw material for the production of the rubber-elastic holders consists of conveyor belts, expediently scrap conveyor belts, from which suitable rubber plates can be punched out, similarly to the case of old motor vehicle tyres.

In a similar manner to motor vehicle tyres, these rubber plates produced from conveyor belts have the necessary strength and elasticity because of the fabric inserts.

According to another advantageous embodiment of the present invention, the elastic holders are com-posed of plastics material. They are, for example, directly moulded by the injection-moulding process with the required fastening apertures for fastening on the roller and for fastening the holders for the milling cutters, and have on the one hand the necessary strength and on the other hand also the necessary elasticity for pressing the milling cutters against the road surface.

Through the use of reinforcing fillers, such as, for example, glass fibres, textile fibres and similar materials, the strength of such holders can be further increased. Particularly suitable plastics materials are polyamide plastics, but also elastomeric plastics such as rubber, butadiene rubber, and the like. The last-mentioned materials are then expediently formed into the desired holders by suitable vulcanisation processes, while textile or steel wire fabric inserts may be used to obtain the required strength properties.

It has been found very expedient for the resilient holders to be fastened on the roller with the interposition of a spacer. In this way the distance between the milling cutters and the roller is increased, so that in the working position a substantially greater spring deflection is available and thus the force pressing the milling cutters against the road surface can be more effectively controlled by varying the height adjustment of the milling roller in relation to the chassis.

The milling cutters themselves are expediently fastened on the holders at an angle of less than 90° relative to the longitudinal axis of the holders. In this way the change of direction of the milling cutters occurring when the latter are pressed into contact is compensated, so that the milling cutters also act on the road surface substantially at right angles in the operative position.

As already mentioned above, it has been found expedient to give the holders a width such that two or more milling cutters can be fastened on them. A holder width of 15 to 20 cm is found very advantageous for this purpose. The length of the holders can vary per se, but is limited by the fact that too great a length has the consequence that through the action of centrifugal force during the rotation of the roller the milling cutters are positioned radially outwards, with the result that they apply a hammer action to the road surface, thus leading to undesirable destruction of the road surface. It has thus been found expedient for the length of the holders to be of the order of about 20 cm.

The thickness of the holders and their consequent rigidity must of course also be taken into account here, which means that if particularly thick holders are used their length may also be greater, because with such thicker holders the previously mentioned centrifugal effect does not occur so readily.

The invention is explained in greater detail below with reference to the exemplary embodiments illustrated in the accompanying drawings, in which.

Figure 1:
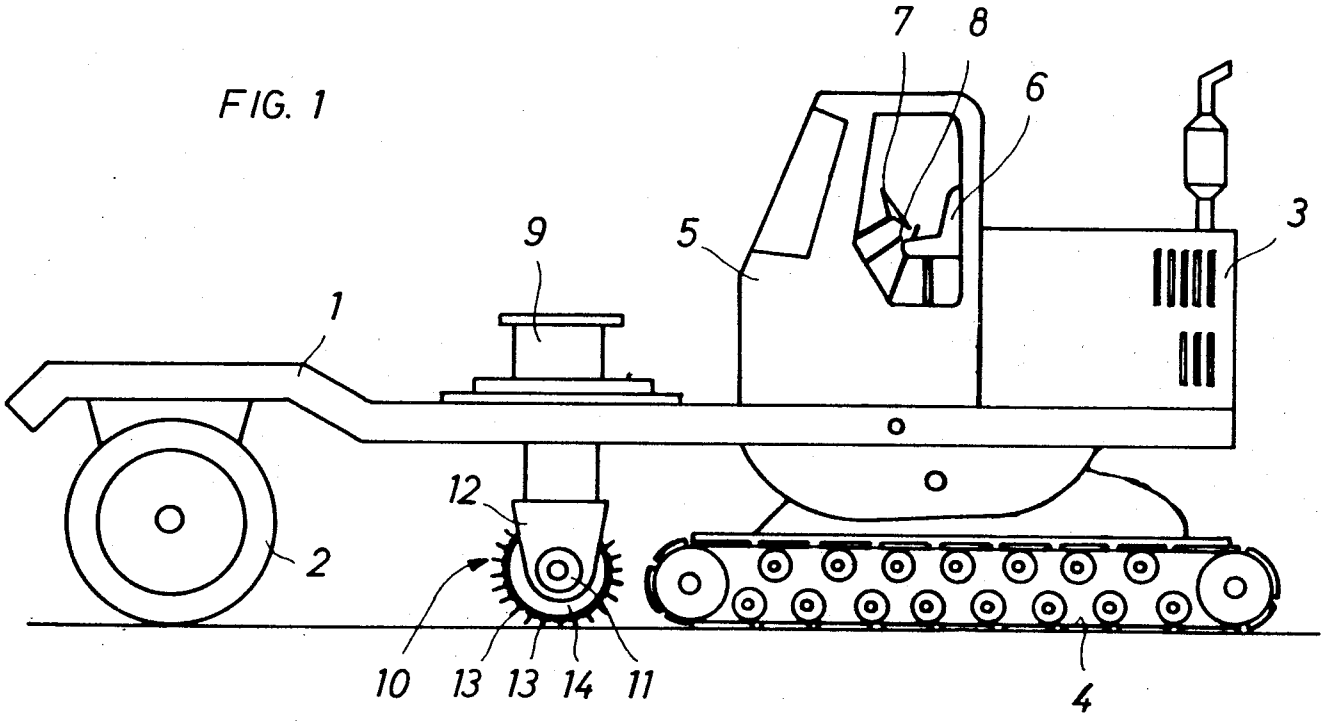
FIG. 1 is a side view of a machine according to the invention for roughening road surfaces.

The road surface roughening apparatus shown in FIG. 1 is substantially similar to the usual machines for milling large areas of road surfaces. It consists of a chassis 1 provided with a pair of front wheels 2 and with a crawler unit 4 driven by an engine 3. For operating purposes a driver's station 5 with seat 6, steering wheel 7 and operating lever 8 is provided. A milling roller 10 is mounted on this chassis 1, being vertically adjustable by means of hydraulic jacks 9 and driven by hydraulic motors 11, which are disposed on both sides of the mounting 12 and drive the roller 14 equipped with cutters 13.

Figure 2:
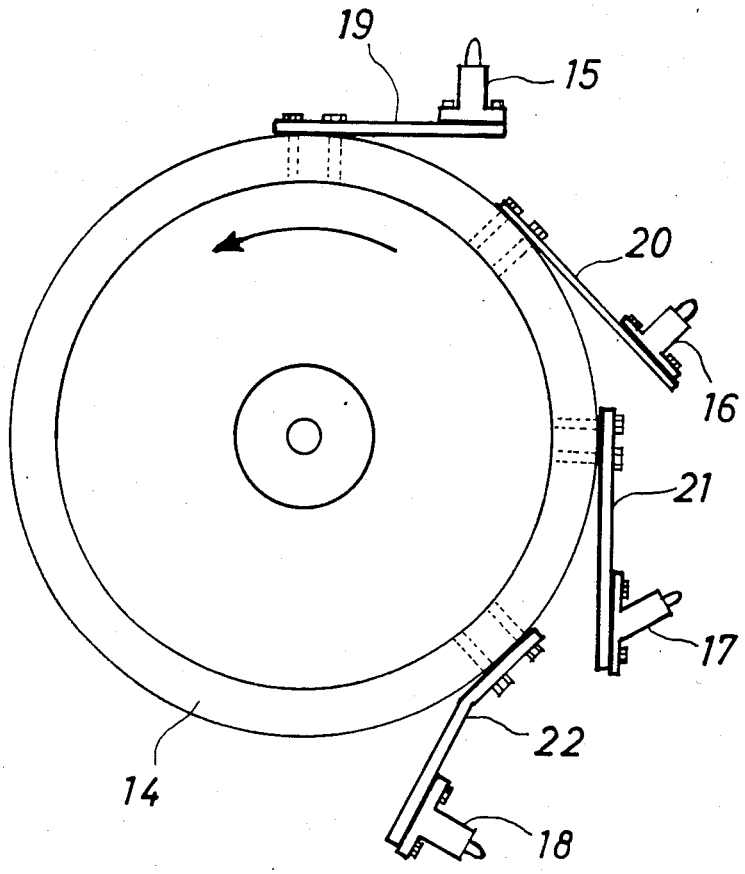
FIG. 2 is a side view in section of a roller according to the invention, equipped with roughening cutters of different construction, which are fastened on the roller by means of leaf springs.

According to the present invention the cutters 13 have special shapes, as can be seen in FIG. 2, which shows various shapes of the cutters. The milling cutters 15 to 18 are fastened by a corresponding holding device to one end of leaf springs 19, 20, 21 and 22, while the other end of the leaf springs is screwed on the roller 14. The arrangement of the cutters shaped in this manner and of their leaf springs, relative to the direction of rotation, can be clearly seen in FIG. 2 of the drawings, which shows that, viewed in the direction of rotation, the cutters are mounted on the rear end of the respective leaf spring.

The thickness of the leaf springs 19, 20, 21 and 22 can vary, in order thus to adapt the contact pressure force to individual requirements.

Furthermore, the leaf spring (22) can also be prestressed in order to obtain additional bearing pressure on the road surface which is to be roughened.

The length of the leaf springs may per se vary and may also be selected in accordance with the desired contact pressure force and the desired spring deflection. It preferably amounts to 10–20 cm.

Through the adjustment of the height of the milling roller 10 by means of the hydraulic jack 9, it is in addition also possible to vary the bearing pressure on the road surface.

The cutter 17 fastened on the leaf spring 21 is fastened at an angle of less than 90° in relation to the longitudinal axis of the leaf spring. An arrangement of this kind gives particularly good roughening results, while in addition the cutter has a particularly long life.

Figure 3:
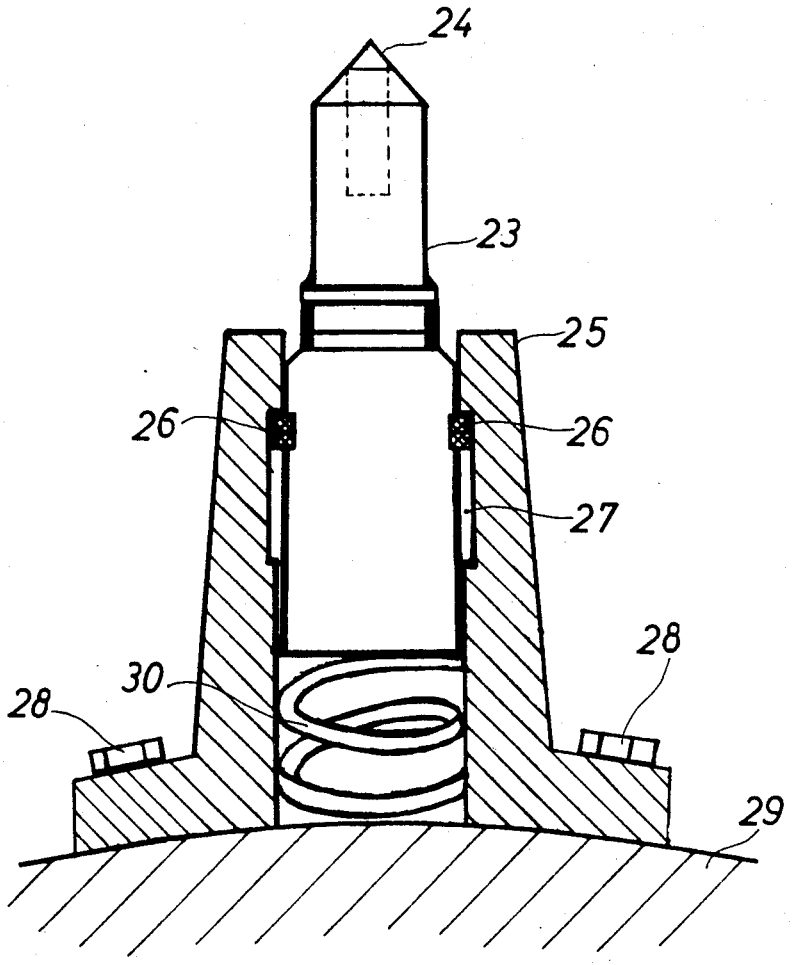
FIG. 3 shows a different construction of a roughening cutter fastened resiliently on the roller.

FIG. 3 shows a different construction of the milling cutter. The latter is here a round-stem cutter 23, which is provided with a sintered carbide tip 24 in order to lengthen its life. This round-stem cutter 23 is disposed in the bore of a holder 25, where it is held by means of a spring ring 26 in an elongated groove 27. The holder 25 is screwed on the roller 29 by means of the screws 28. Between the roller 29 and the end of the round-stem cutter 23 is disposed a compression spring 30, which is intended to oppose the movement of the round-stem cutter 23 into the interior of the holder 25. The spring force of the compression spring 30 can be selected to correspond to individual requirements.

Figure 4:
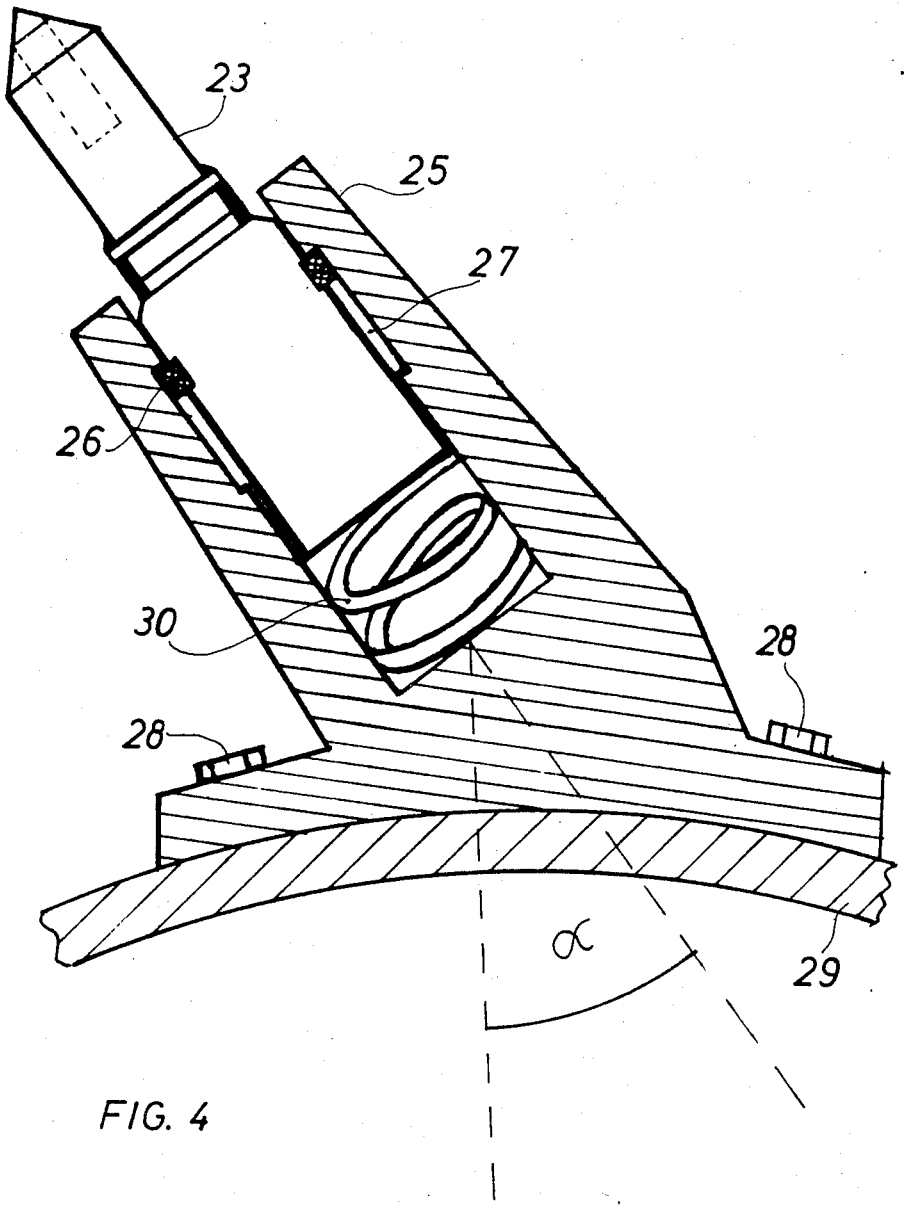
FIG. 4 shows a different form of the milling cutter shown in FIG. 3, the axis of the milling cutter being inclined away from the radial direction by an angle $\alpha$ in the direction of rotation.

In the embodiment shown in FIG. 4 the axis of the round-stem cutter 23 is inclined by the angle $\alpha$ away from the radial direction of the milling roller 14, in the direction of rotation.

As also described in connection with FIG. 3, the milling cutter 23 may in this case be pushed into the holder 25 against the force of the compression spring 30. The strength of the compression spring 30 is therefore likewise selected to correspond to the desired contact pressure force.

Figure 5:
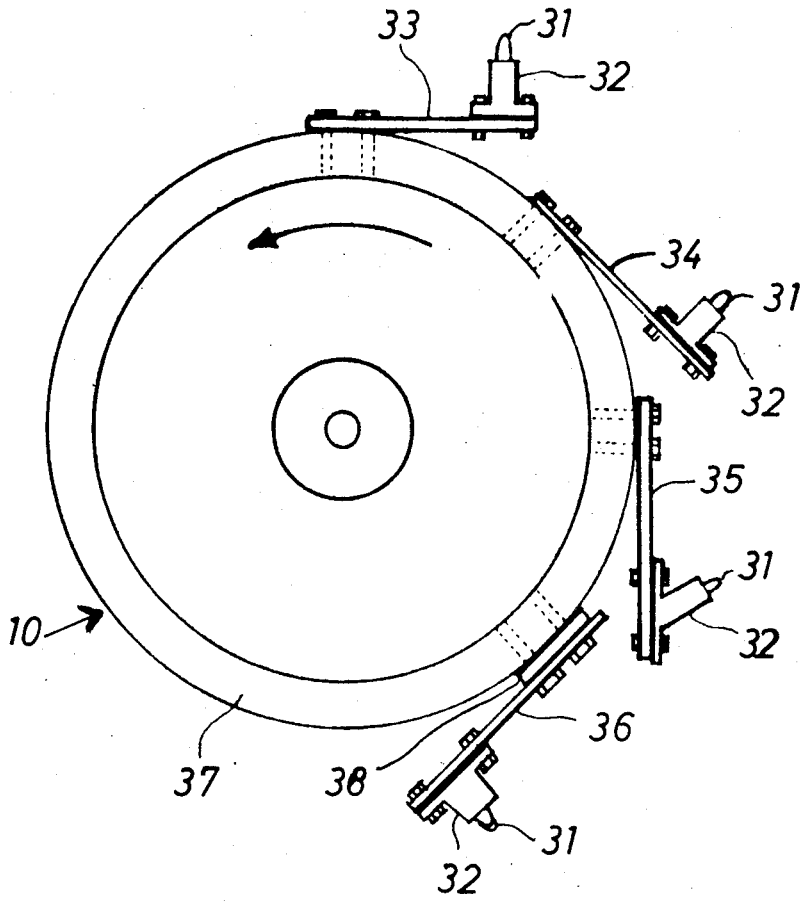
FIG. 5 is a side view in section of a roller according to the invention, showing the different possible arrangements of the milling cutters on the elastic holders.

In the embodiment illustrated in FIG. 5 the cutters 31 provided for roughening purposes are fastened in corresponding holder housings 32 by means of elastic holders 33, 34, 35 and 36 on the outer surface 37 of the milling roller 10. Different forms of construction of elastic holders are shown for demonstration purposes in FIG. 5. The holder 33 consists of a normal elastic holder, which, for example, has been punched out of conveyor belt material and fastened by means of screws on the outer surface 37 of the milling roller 10. At its free end the holder housing 32 for the milling cutter 31 is screwed on.

The elastic holder 34 is one which has been made of high-grade plastics material with reinforcing fillers and consequently has the necessary strength despite its reduced thickness. The elastic holder 35 is once again a holder made of reinforced rubber-elastic material, being, for example, punched out of the casings of motor vehicle tires. At its end is screwed on a holder housing 32 for the milling cutter 31, this holder housing being fastened on the holder at an angle of less than 90° in relation to the longitudinal axis of the holder.

The holder 36 is screwed on the outer surface 37 of the milling roller 10 with the interposition of a spacer 38. The spring deflection for the milling cutter fastened on the end of the holder 36 is thereby lengthened.

Figure 6:
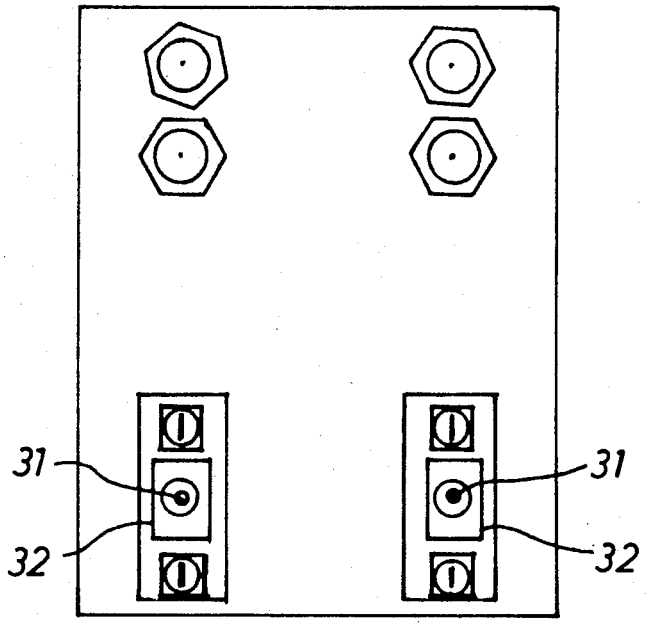
FIGS. 6 is a plan view of an elastic holder according to the present invention, with two milling cutters mounted on it.

The elastic holder shown in plan in FIG. 6 is one which has a width sufficient to receive two holder housings 32 for the milling cutters 31. The width of these elastic holders may, however, also be increased still further, so that even three or more holder housings for the milling cutters 31 can be disposed on them.

The thickness of the holders may, for example, amount to from 1 to 3 cm. When holders punched out of old tyres are used, this thickness expediently corresponds to the thickness of the tread of the tyres, or in the case of holders made from conveyor belt material to the thickness of the conveyor belt. For holders of plastics material the thickness is usually less. In addition, the thickness of the holder depends on the desired contact pressure force by which the milling cutter is to be pressed against the road surface. The thickness of the holder will therefore expediently be selected in accordance with requirements in the individual case.

I claim:

1. An apparatus for roughening road surfaces having a chassis, a roller mounted on each chassis which is vertically adjustable relative to the road and disposed transversely to the direction of travel of the chassis, a motor to drive the roller, and having milling cutters associated with said rollers the improvement consisting of (a) rubber elastic holders which extend tangentially to the periphery of said roller at one end thereof and which carry at least one of said milling cutters at the other end thereof;

(b) means including spacer means fastening said one end of said rubber elastic holders to said outer surface of said roller, and (c) means fastening the other end of said rubber elastic holders to said milling cutters.

2. Apparatus according to claim 1, characterized in that the rubber-elastic holders are punched out of used motor vehicle tires.

3. Apparatus according to claim 1, characterized in that the rubber-elastic holders are punched out of conveyor belts.

4. Apparatus according to claim 1, characterized in that the rubber-elastic holders are made of rubber-elastic materials with the inclusion of reinforcing inserts by the vulcanization method.

* * * * *